US005879208A

United States Patent [19]

Adler

[11] Patent Number: 5,879,208

[45] **Date of Patent: *Mar. 9, 1999**

[54] WATER APPARATUS

[76] Inventor: Constance Adler, 1297 Woodland West, Waco, Tex. 76712

[ * ] Notice: The term of this patent shall not extend beyond the expiration date of Pat. No. 5,577,940.

[21] Appl. No.: 961,955

[22] Filed: Oct. 31, 1997

Related U.S. Application Data

[63] Continuation-in-part of Ser. No. 751,408, Nov. 21, 1996, which is a continuation-in-part of Ser. No. 604,827, Feb. 23, 1996, Pat. No. 5,577,940.

[51] Int. Cl.[6] ..... B63H 16/20

[52] U.S. Cl. ..... 440/27

[58] Field of Search ..... 440/21, 26, 30, 440/90; 441/129, 130; 472/128, 129

[56] References Cited

U.S. PATENT DOCUMENTS

| | | | |
|---|---|---|---|
| 514,489 | 2/1894 | McCloskey . | |
| 1,920,391 | 8/1933 | Herwig . | |
| 3,999,501 | 12/1976 | Duarte | 440/37 |
| 5,308,268 | 5/1994 | Schmid . | |
| 5,577,940 | 11/1996 | Adler | 440/27 |

FOREIGN PATENT DOCUMENTS

| | | |
|---|---|---|
| 727.223 | 6/1932 | France . |
| 310317 | 10/1917 | Germany . |

*Primary Examiner*—Ed L. Swinehart
*Attorney, Agent, or Firm*—Arthur F Zobal

[57] ABSTRACT

The apparatus has front and rear floatable members pivotally coupled together such that the two members may turn relative to each other. A seat is coupled to the rear member for supporting a person. Paddles are coupled to a paddle shaft supported by the front member. Pedals are coupled to the paddle shaft for rotating the paddles shaft and hence the paddles for movement of the paddles through the water for moving the apparatus in the water. In the preferred embodiment, a paddle support member is coupled to opposite ends of the paddle shaft and paddles are coupled to the outward sides of the paddle support members. In another embodiment, two rods are pivotally coupled to opposite sides of the rear end of the front member respectively. Paddles are coupled to the lower ends of the two rods respectively. Each of the paddles includes two plate members pivotally coupled to the lower end of its rod. As the lower ends of the two rods are moved rearward, the plate members of the paddles move outward to extended positions to move the front and rear members in the water. As the lower ends of the two rods are moved forward, the plate members of the paddles move together to minimize movement of the front and rear members in the water.

21 Claims, 10 Drawing Sheets

Fig.23
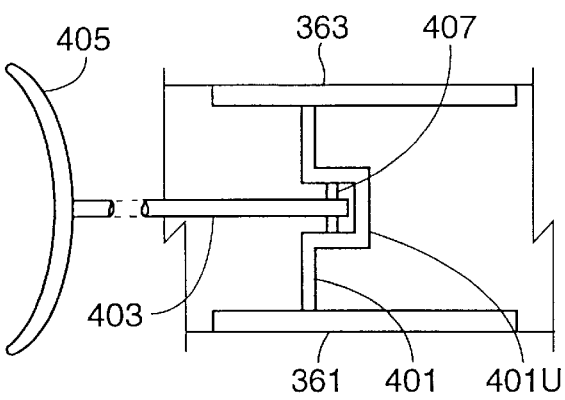
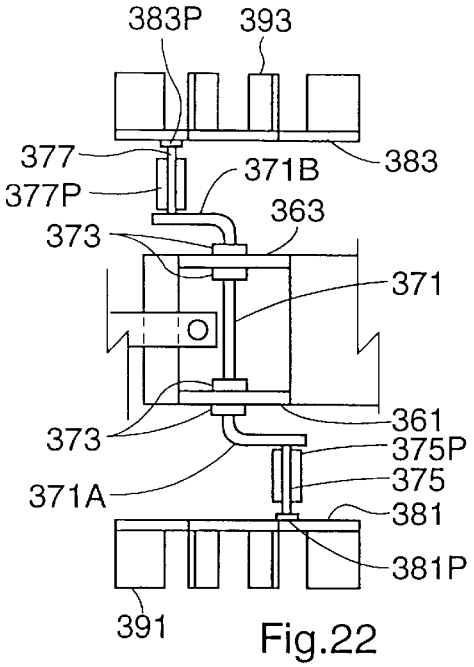
Fig.22
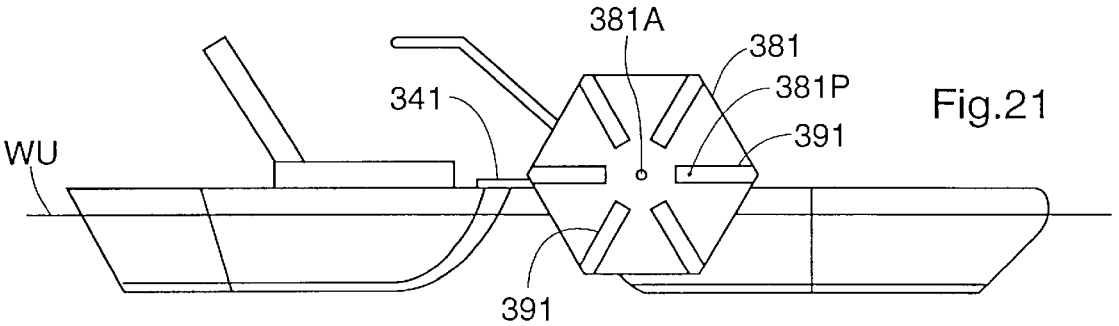
Fig.21
Fig.20
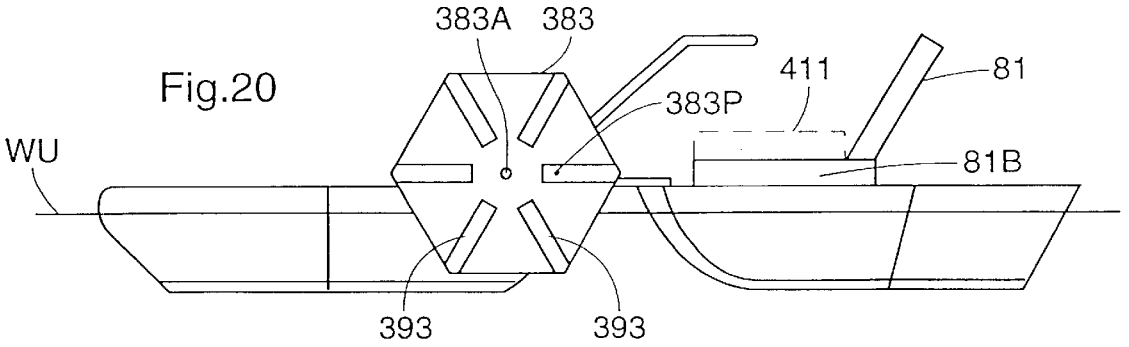

WATER APPARATUS

This application is a continuation-in-part of U.S. patent application Ser. No. 08/751,408, filed Nov. 21, 1996, which is a continuation-in-part of U.S. patent application Ser. No. 08/604,827, filed on Feb. 23, 1996, now U.S. Pat. No. 5,577,940, issued Nov. 26, 1996.

BACKGROUND OF THE INVENTION

1. Field of the Invention

The invention relates to water apparatus having paddles for moving the apparatus in water.

2. Description of the Prior Art

U.S. Pat. Nos. 514,489; 1,920,391; 5,308,268; German Patent No. 310317 and French Patent No. 727,223; disclose different types of water cycles and small boats.

SUMMARY OF THE INVENTION

The invention comprises a front and rear floatable members pivotally coupled together with means on the front member for supporting paddles for use for moving the apparatus in the water.

In the embodiments disclosed, a connecting member is coupled to the front end of the rear member and to the rear end of the front member such that the two members may turn relative to each other. A seat is coupled to the rear member for supporting a person. Paddles are coupled to a paddle shaft supported by the front member. Pedals are coupled to the paddle shaft for rotating the paddles shaft and hence the paddles for movement of the paddles through the water for moving the apparatus in the water. In a preferred embodiment, a paddle support member is coupled to opposite ends of the paddle shaft and paddles are coupled to the outward sides of the paddle support members.

In another embodiment, two rods are pivotally coupled to opposite sides of the rear end of the front member respectively. Paddles are coupled to the lower ends of the two rods respectively. Each of the paddles comprises two plate members pivotally coupled to the lower end of its rod. As the lower ends of the two rods are moved rearward, the plate members of the paddles move outward to extended positions to move the front and rear members in the water. As the lower ends of the two rods are moved forward, the plate members of the paddles move together to minimize movement of the front and rear members in the water.

BRIEF DESCRIPTION OF THE DRAWINGS

FIGS. 20 and 21 are opposite side views of the apparatus of FIG. 19.

FIG. 22 is an enlarged partial view of the paddle mechanism of FIG. 19.

FIG. 23 is a top plan view of the handle connecting mechanism of the apparatus of FIG. 19.

DESCRIPTION OF THE PREFERRED EMBODIMENTS

Figure 1:
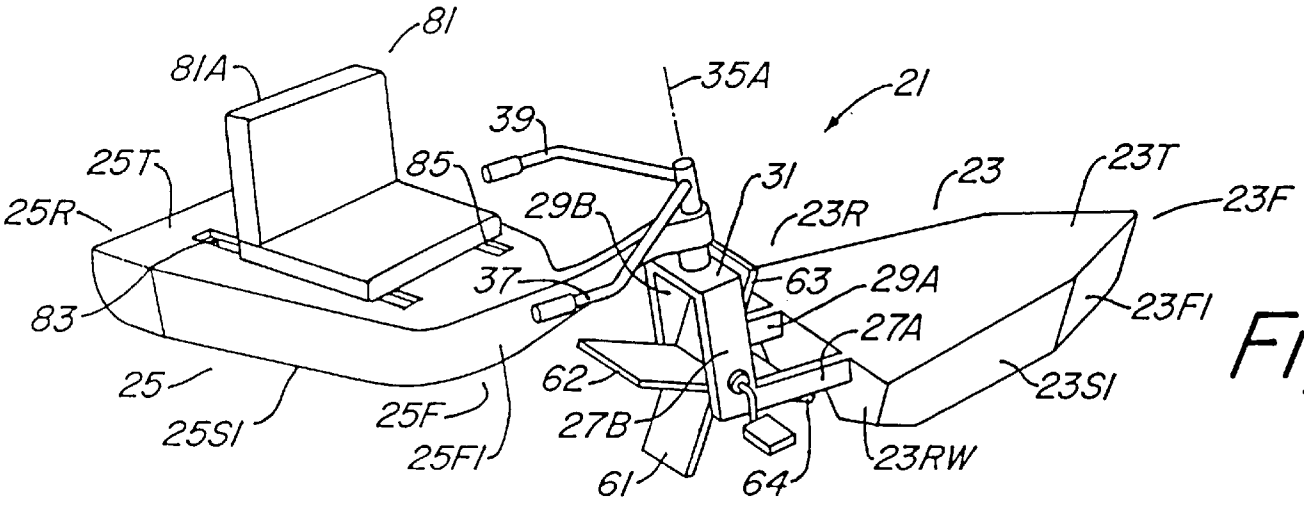
FIG. 1 is a right side view of the apparatus of one embodiment of the apparatus with the front and rear members turned relative to each other.
Figure 2:
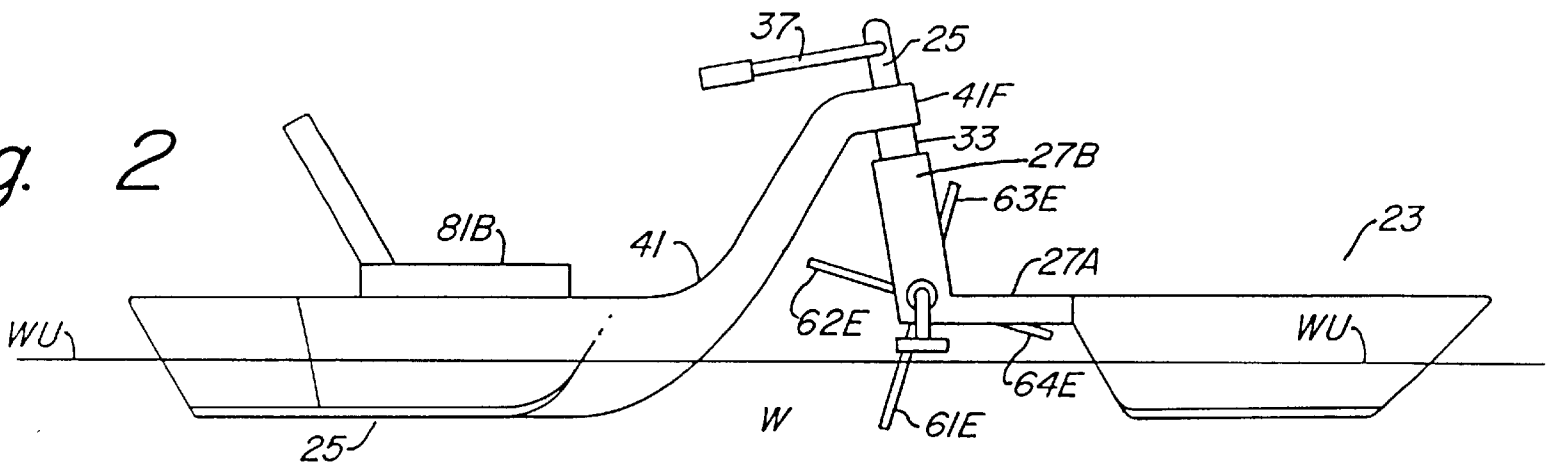
FIG. 2 is a side view of the apparatus of FIG. 1.
Figure 3:
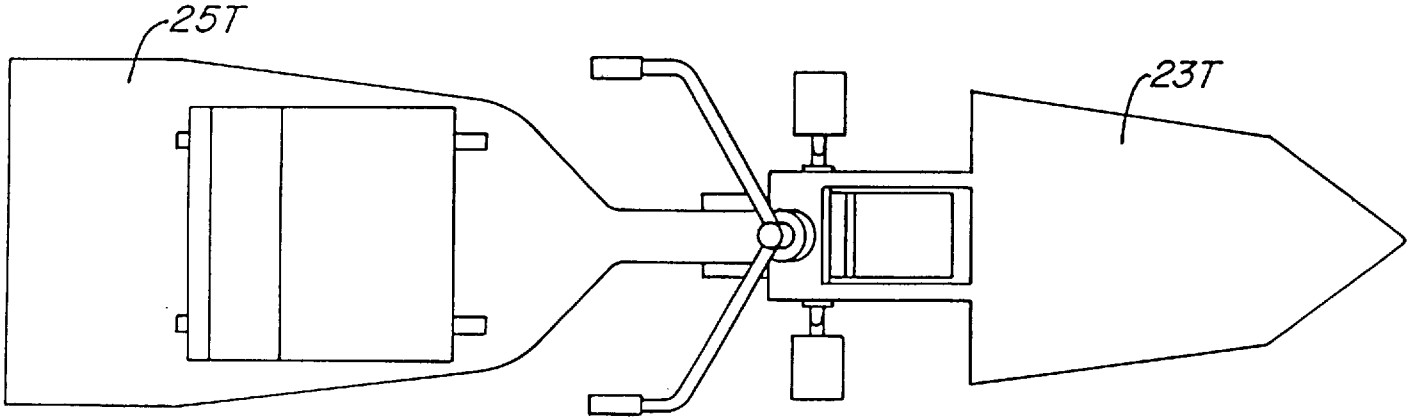
FIG. 3 is a top plan view of the apparatus of FIG. 1.
Figure 4:
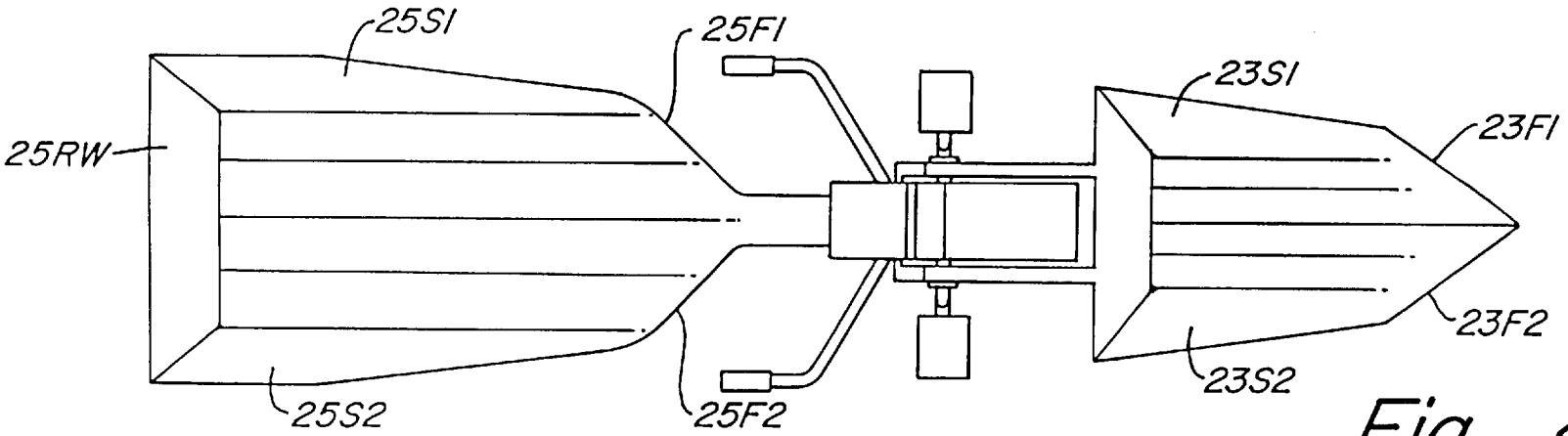
FIG. 4 is a bottom plan view of the apparatus of FIG. 1.
Figure 5:
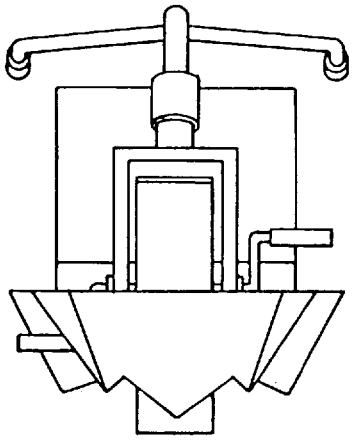
FIG. 5 is a front elevational view of the apparatus of FIG. 1.
Figure 6:
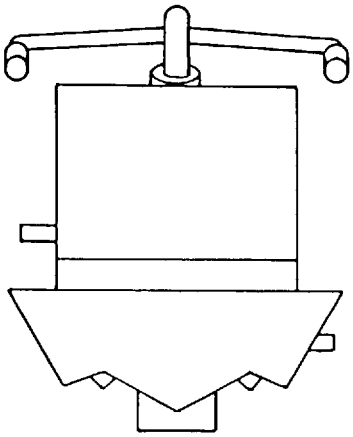
FIG. 6 is a rear elevational view of the apparatus of FIG. 1.
Figure 7:
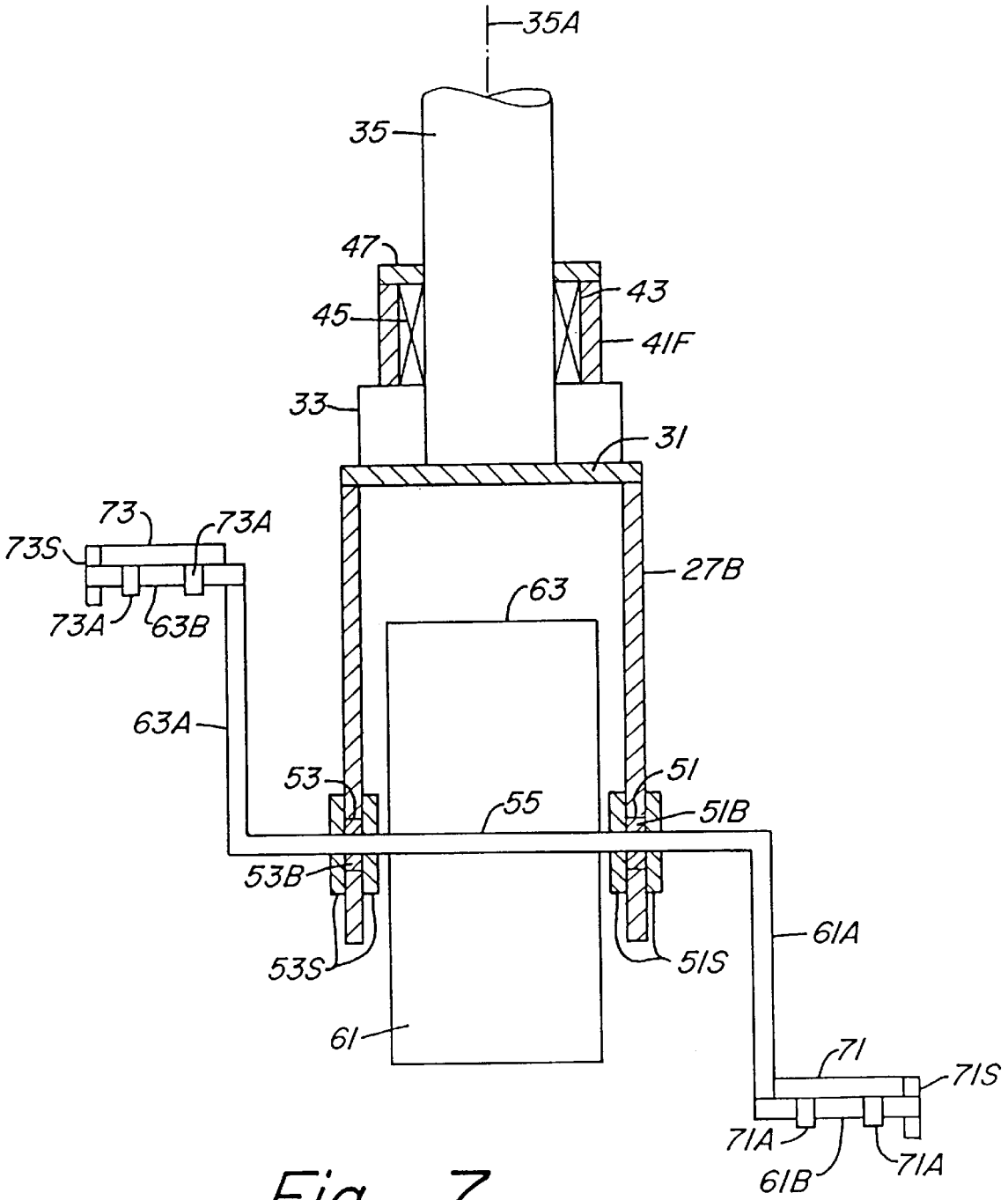
FIG. 7 is an enlarged view of the main shaft and pedal and paddle mechanism of the apparatus of FIG. 1.
Figure 8:
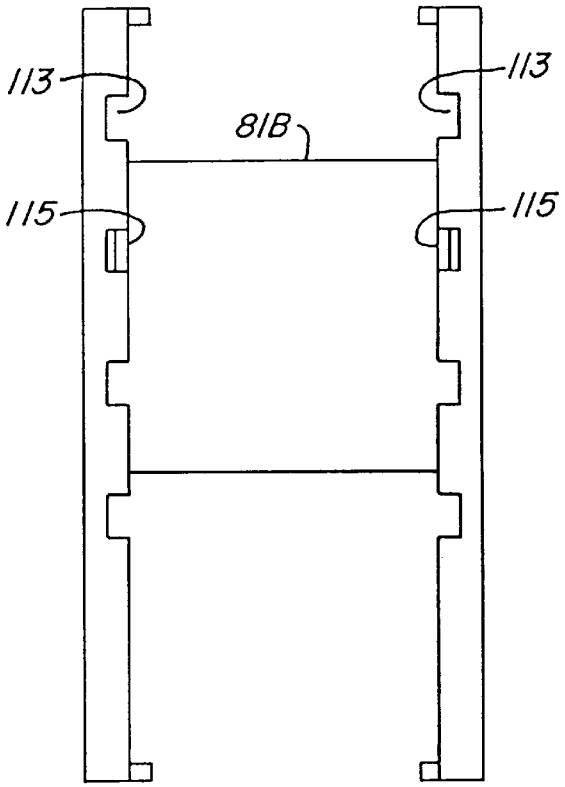
FIGS. 8 and 9 illustrate an embodiment for slidably holding the seat in place.
Figure 11:
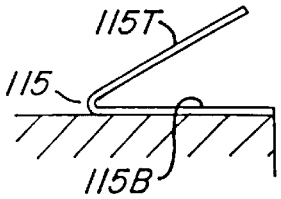
FIGS. 10 and 11 illustrate a spring clip in compressed and expanded positions respectively.
Figure 10:
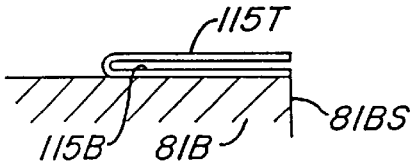
Figure 9:
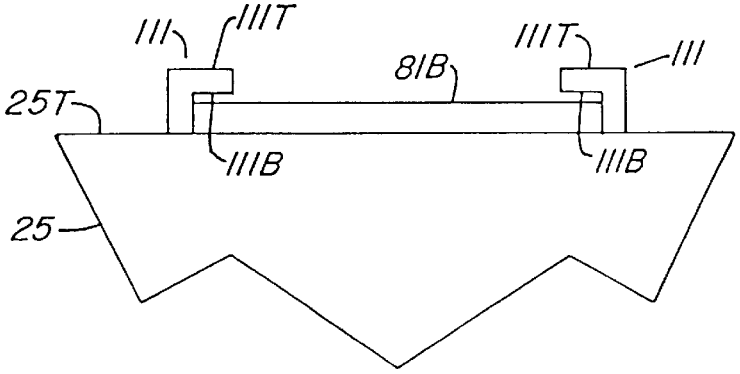
Figure 17:
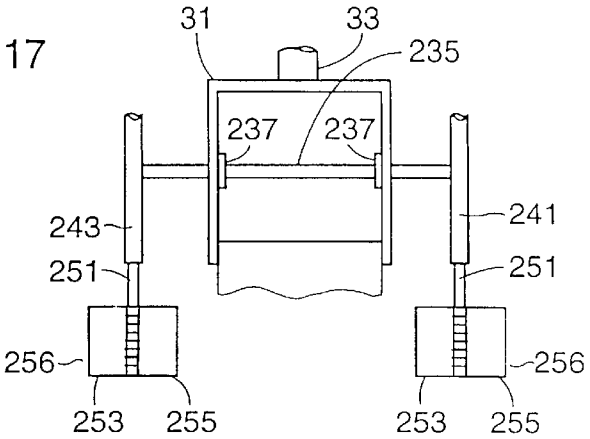
FIG. 17 is a partial rear end view of the front floatable member of FIG. 12.

Referring now to the drawings the water cycle apparatus of the embodiment of FIGS. 1–11 is identified at 21. It comprises a front floatable member 23 having a front end 23F and a rear end 23R and a rear floatable member 25 having a front end 25F and a rear end 25R. Member 23 and 25 are constructed to float in water W. The front member 23 comprises a top wall 23T, a bottom wall 23B, a rear wall 23RW, two side walls 23S1 and 23S2 and a front wall 23F1 and 23F2 defining a hollow cavity filled with a material such as Styrofoam. The rear member 25 comprises a top wall 25T, a bottom wall 25B, a rear wall 25RW, two side walls 25S1 and 25S2 and a front wall 25F1 and 25F2 defining a hollow cavity filled with a material such as Styrofoam. The walls of members 23 and 25 may be formed of a suitable metal, plastic, or fiberglass.

Members 23 and 25 may also be molded from a suitable buoyant material.

Secured to the rear wall 23RW of member 23 are two spaced apart support members 27A and 29A which extend rearward and then upward and rearward at 27B and 29B. An upper cross member 31 is connected to the upper ends of members 27B and 29B.

The cross member 31 supports a cylindrical member 33 having an upper cylindrical shaft 35 which extends upward and rearward defining a pivot axis 35A. Secured to the top of the shaft 35 are two handle bars 37 and 39.

The front 25F of the member 25 has a connecting member 41 connected thereto which extends forward and upward with an aperture 43 formed through the forward end 41F for receiving the shaft 35. An annular bearing 45 is provided in the aperture 43 for engaging the shaft 25. An annular member 47 is secured to the shaft 35 to hold the front end 41F of connecting member 41 against the member 33.

The shaft 35 may be turned or pivoted to the left or right in the aperture 43 of the connecting member 41 to turn the front member 23 to the left or right relative to the rear member 25.

Apertures 51 and 53 are formed through the support members 27A, 27B and 29A, 29B for receiving a cylindrical paddle shaft 55 which extends transverse relative to the pivot shaft 35A and which is horizontal to the upper level WU of the water W when the members 23 and 25 are located in a body of water. Members 51B and 53B are annular bearings and members 51S and 53S are annular members secured to the shaft 55 for maintaining the shaft 55 and bearings in the apertures 51 and 53 as shown.

Secured to the shaft 55 inside the support members 27A, 27B and 29A, 29B are the inner ends of four paddles 61–64 with adjacent paddles being located 90 degrees apart.

Coupled to the outer ends of the shaft 55 are L-shaped rods 61A, 61B and 63A, 63B which are located 180 degrees apart.

Rod members 61B and 63B are transverse to rod members 61A and 63A respectively and support foot rests 71 and 73 respectively. Foot rest 71 has annular members 71 A secured thereto through which member 61B extends to allow the foot rest 71 to rotate about rod member 61B. An annular member 71S is secured to the end of rod member 61 B to maintain the foot rest 71 in place. Foot rest 73 has annular members 73A secured thereto through which member 63B extends to allow the foot rest 73 to rotate about rod member 63B. An annular member 73S is secured to the end of rod member 63B to maintain the foot rest 73 in place.

The paddle shaft 55 is located above the top surface of the water such that as one rotates the pedals 61A, 61B, 71 and 63A, 63B, 73 the outer ends 61E–64E of the paddles 61–64 enter and then leave the water to move the front member 23 and hence the rear member 25 forward or rearward depending on which direction one rotates the pedals.

A seat 81 is provided on the rear member 25 to support a person such that his or her legs may operate the pedals while his or her arms grasp the handle bars 37 and 37 to guide the apparatus in the water. The position of the seat may be adjusted forward or rearward relative to the rear member 25.

Figure 13:
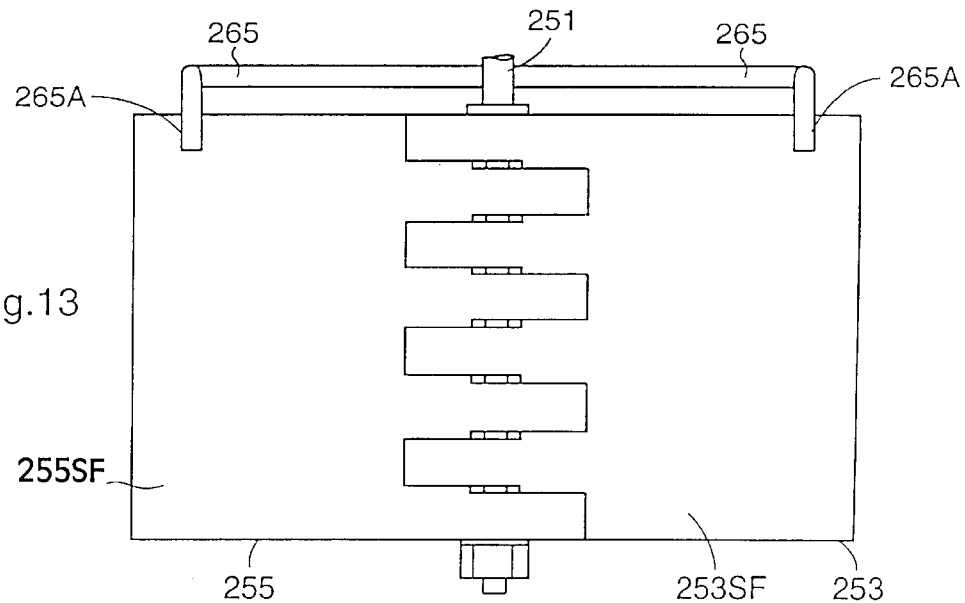
FIG. 13 is a plan view of one side of one of the paddles of the apparatus of FIG. 12 in an expanded position.
Figure 12:
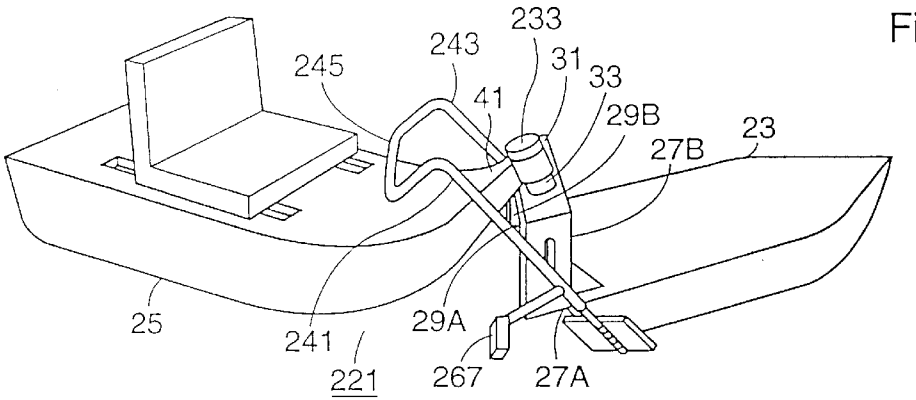
FIG. 12 is a right side view of the apparatus of another embodiment with the front and rear members turned relative to each other.
Figure 14:
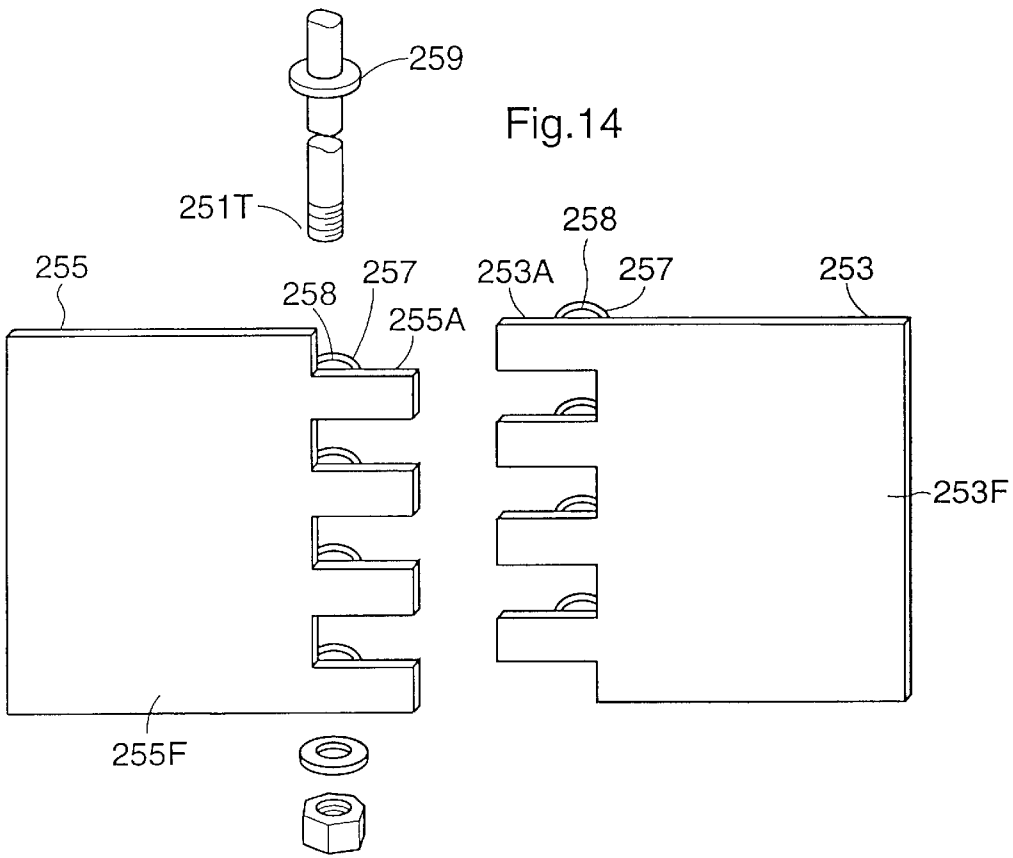
FIG. 14 is an exploded view of the paddle of FIG. 13.

Referring to FIGS. 8–11, two L-shaped tracks 111 are attached to the top 25T of member 25. Slots 113 are formed in the tracks 111. Two spring members 115 are attached to the seat 81B on opposite sides thereof below the bottom surfaces 111B of the top edges 111T of the tracks 111. Each member 115 has a bottom member 115B and a top member 115T. The bottom members 115B are attached to the top of the seat member 81B on opposite sides thereof. In FIGS. 13 and 14 one side edge of the seat member 81B is shown at 81BS. The top members 115T can be pushed down to locate them below the lower surfaces 111B of the track edges 111T to allow the seat member 81B to be moved forward and rearward to different positions to align the pair of spring members 115 with a selected pair of the slots. The spring top members 115T then spring up in the selected pair of slots 113 to hold the seat member 81B in place.

Thus there is provided a simple and effective water cycle that can be operated manually by a person for movement in the water. It is very maneuverable since the pedals and paddles are on the front member and it can be turned in a small turning radius. There is no chain which may otherwise get caught in vegetation, etc. in the water. There is a minimum of maintenance and it can be readily folded to a compact position for storage in a car or truck. The apparatus has a low center of gravity which makes it more stable and thus does not need a large width to prevent tipping. The low structure also makes it easy to mount.

Although a single floatable rear member 25 is shown, it is to be understood that two additional floatable rear members may be provided for more stability. In this modification the two floats may be attached to a frame which slides down over the seat back 81A, thus securing the floats to the rear member 25. This provides an easily attachable and removable stabilizer.

Referring now to FIGS. 12–18, the apparatus is identified at 221. It comprises the same rear floatable member 25 as described previously and a front floatable member 23 which is similar to that described previously except that the end supports 27A and 29A are spaced further apart. Coupled to the end supports 27A and 29A are the upward extending members 27B and 29B with the cross member 31 connected to the upper ends thereof. The cylindrical member 33 is attached to the cross member 31 for receiving the aperture 43 of the connecting member 41. An enlarged cylindrical member 233 is attached to the top of the member 33.

A rotatable metal shaft 235 extends through the end supports 27A and 29A. Members 237 are bearings.

Figure 18:
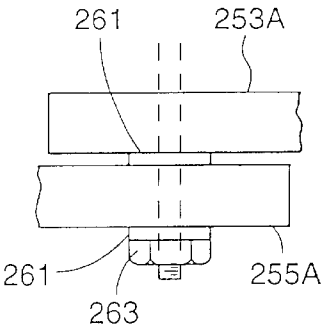
FIG. 18 is a partial view of the paddle of FIG. 13 showing washers between the arms thereof.

Fixedly coupled to the ends of the shaft 237 are two metal rods 241 and 243. The upper ends of the rods 241 and 243 are coupled together by a handle 245 such that an operator sitting in the seat 81 can pivot the rods 241 and 243 together back and forth relative to the rear end of the front member 23. Fixedly to the lower ends of the rods 241 and 243 are smaller rods or shafts 251. Pivotally coupled to each rod 251 are two plate members 253 and 255 which form two identical paddles 256. The members 253 and 255 have spaced apart arms 253A and 255A. As shown in FIG. 14, annular members 257 having apertures 258 formed therethrough are attached to the sides 253R and 255R of the plate member 253 and 255 for receiving the rod 251. The rod 251 has a stop 259 secured thereto at a position away from its threaded lower end 251T. As shown also in FIG. 13, the arms 253A and 255A overlap the inner portions of the plate members 253 and 255 on their front sides 253F and 255F when in an open or expanded position to limit pivotal movement of the members in the forward direction. As shown in FIG. 18 washers 261 are provided between adjacent arms 253A and 255A and between the lower end of the member 255 and a bolt 263 used to secure the plate members 253 and 255 to the rod 251. The sides 253SF and 255SF of the paddle members face forward and the sides 253R and 255R of the paddle members face rearward when in their outward extended positions. Stops 265 are fixed to the rod 251 and extend outward, forward and then downward at 265A to prevent the members 253 and 255 from moving around the rod 251 to different closed and outward extended positions to insure that the sides 253F and 255F always face forward in their extended positions. Pedals 267 are connected to the rods 241 and 243 for supporting the operator's feet and to help the operator move the handle 245 and rods 241 and 243 back and forth.

In operation, the operator will move the handle 245 forward which will cause the lower ends of the rods 241 and 243 to move rearward. This causes the water to force the plate members 253 and 255 to open to outward extended positions as shown in FIG. 13 to move the floatable members 23 and 25 forward in the water. As the operator pulls the handle 245 rearward, the lower ends of the rods 241 and 243 move forward, causing the water to close the plate members 253 and 255 to the position shown in FIG. 16 to minimize movement of the members 23 and 25 in the water.

Figure 15:
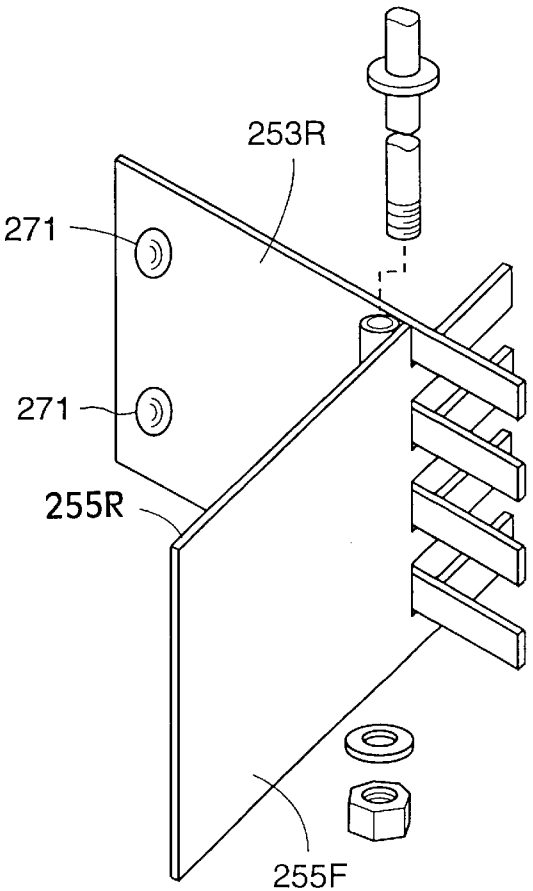
FIG. 15 illustrates the assembly of the paddle of FIG. 13.
Figure 16:
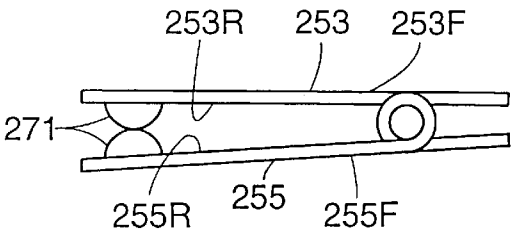
FIG. 16 is a side view of the paddle of FIG. 12 in a closed position.

As shown in FIGS. 15 and 16, spacers 271 are coupled to the rear sides 253R and 255R of the plate members 253 and 255 to prevent them from closing completely to allow water to enter between the plate members when they are moved rearward to insure that the water pressure will force them to their outward extended positions.

Referring to FIGS. 19–23 the apparatus is identified at 321. It comprises a rear floatable member 325 and a front floatable member 323. The member 325 has the seat 81 which can be slidably mounted in slots 83 and 85 for adjustment purposes or employ the adjustment mechanism as described in connection with FIGS. 8–11 for adjusting the position of the seat 81. Two floatable rear members 331 and 333 may be used for providing more stability for the member 325. The floats 331 and 333 can be removably coupled to the rear member by members 335 and 337 which may be attached to the rear member 325 for example by bolts or clamps, or rods inserted through the rear member.

A plate 341 has its front end pivotally coupled to the rear end of the member 323 by a pin 343 and its rear end coupled to the front end of the member 325 by a pin 345 such that the two members 323 and 325 can turn relative to each other. The pins 343 and 345 may be bolts that screw into members 323 and 325 whereby the pins can be removed to separate the members 323 and 325 for transportation or storage purposes.

The rear end 323R of the member is narrower than the front end 323F such that side spaces 351 and 353 are provided on each side of the rear portion 323R rearward of the shoulders 323S1 and 323S2 of the front portion 323F.

Secured to the top of the rear portion 323R are two upright panels 361 and 363. Extending through apertures formed through panels 361 and 363 is a metal shaft 371 which has oppositely extending arms 371A and 371B in the same plane. Members 373 are bearings such that the shaft 361 and its arms can rotate 360 degrees. Fixedly secured to the ends of the arms 361A and 361B are rods 375 and 377 which are in the same plane as the shaft 361 and its arms 361A and 361B. The rods 375 and 377 are fixedly connected to paddle supports 381 and 383 respectively at points 381P and 383P offset from their central axes 381A and 383A respectively. Connected to the outer side of the support 381 are six paddles 391 with adjacent paddles spaced 60 degrees apart. Connected to the outer side of the support 383 are six paddles 393 with adjacent paddles spaced 60 degrees apart. Pedals 375P and 377P are supported by the rods 375 and 377 respectively such that the pedals 375P and 377P can rotate relative to the rods 375 and 377 respectively.

Figure 19:
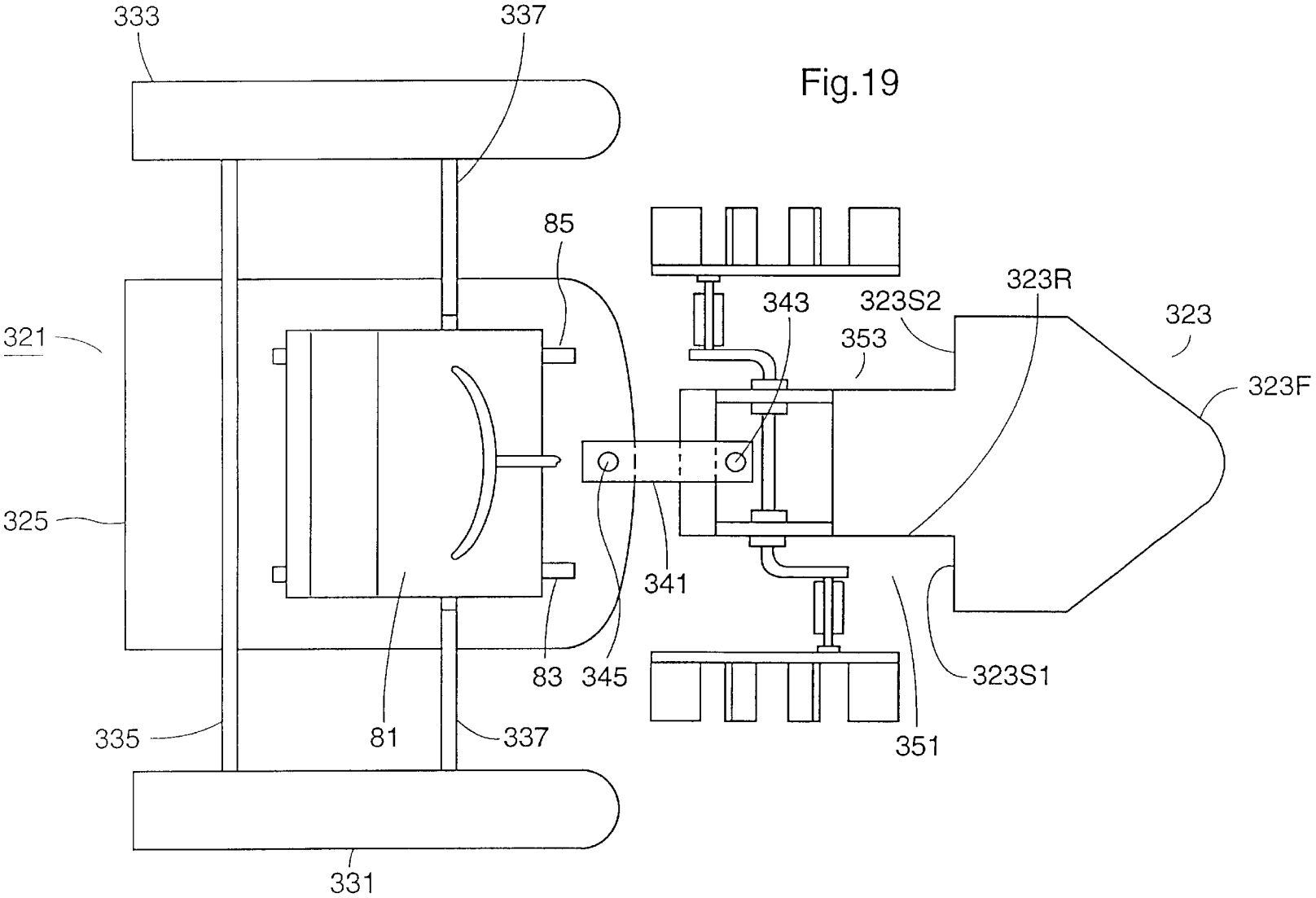
FIG. 19 is a top plan view of a preferred embodiment of the invention.

Although not shown in FIG. 19, a connecting member 401 is connected between the panels 361 and 363 for supporting the shaft 403 of a handle 405. The member 401 has a U-shaped bend 401U for supporting a rod 407. The end of the shaft 403 has an aperture formed therethrough for receiving the rod 405 such that the handle can pivot to an upper operating position or to a lower storage position.

In using the apparatus, a person will sit on the base 81B of the seat 81, hold the handle 403 with his or her arms, place his or her feet on the pedals 375P and 377P and rotate the pedals to rotate the supports 381 and 383 and the paddles 391 and 393 in a direction to move the front member 323 and hence the rear member 325 forward. The operator also can pedal in a reverse direction to move the apparatus in a rearward direction.

The apparatus becomes very efficient with the paddles 391 and 393 facing outward. The paddle supports 381 and 383 act as rudders to facilitate turning of the apparatus.

The connecting member 341 can be made longer if sharper turns are desired. The seat back 81 may be attached to the seat base 81B with hinges so that it can be folded forward flat on the seat base when transporting the apparatus.

Figure 24:
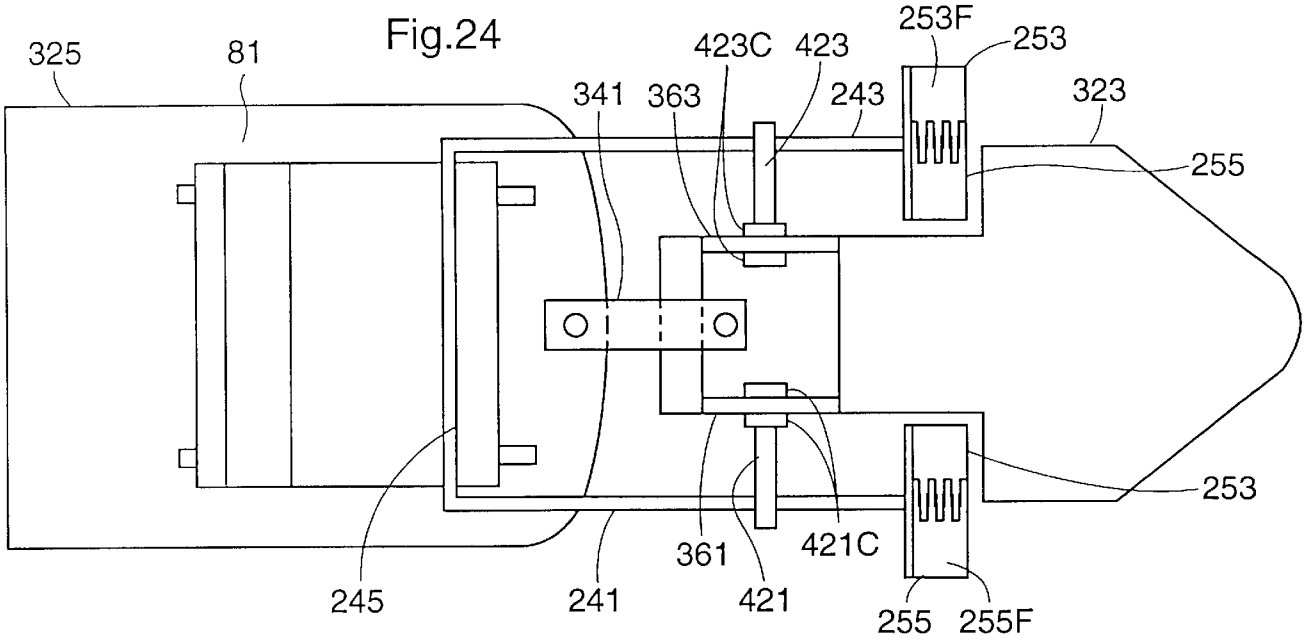
FIG. 24 is a top plan view of another embodiment of the invention.
Figure 25:
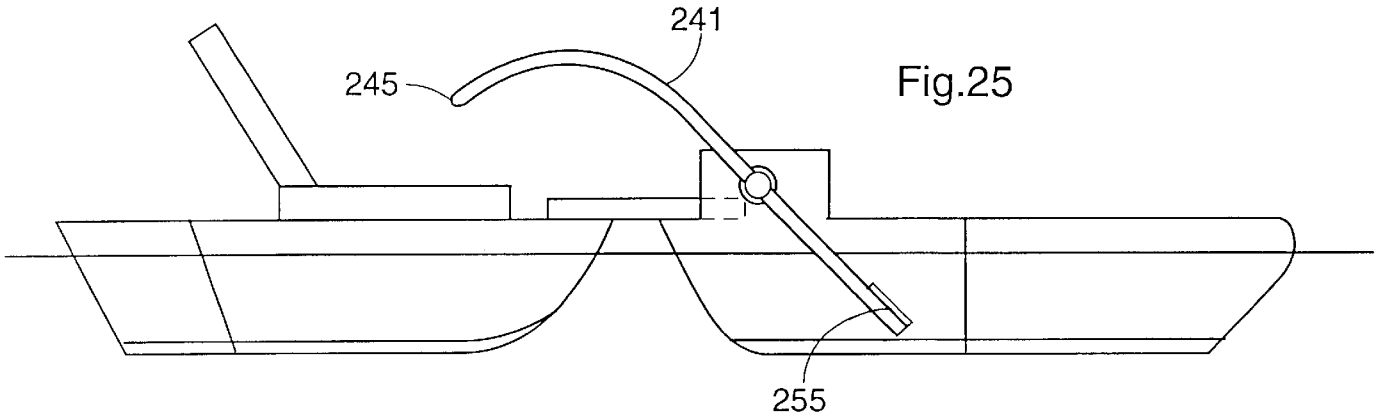
FIG. 25 is a side view of the apparatus of FIG. 24.

Referring to FIGS. 24 and 25, the members 323 and 325 are the same as those disclosed and described in connection with FIGS. 19–23 except for the paddle mechanism which is the same as that disclosed and described in connection with FIGS. 12–18. Thus in FIGS. 12–18, 19–23 and 24 and 25, like reference numerals identify like components or members.

In FIGS. 24 and 25, rods 421 and 423 are rotatably coupled to panels 361 and 363 by way of coupling members 421C and 423C respectively. The ends of the rods 421 and 423 have apertures formed therethrough for receiving the rods 241 and 243 respectively. The rods 241 and 243 are fixedly coupled to rods 421 and 423 respectively.

In operating the apparatus, the operator sits on the 81 and moves the handle 245 back and forth about the pivot axis defined by rods 421 and 423 such that the paddles 253 and 255 open and close to move the member 323 and hence member 325 forward as described in connection with FIGS. 12–18. Although not shown, pedals 267 may be fixedly attached to the rods 241 and 243 for receiving the operator's feet as described in connection with FIGS. 12–18.

I claim:

1. A water apparatus, comprising:

front and rear floatable members constructed to float in water, each of said members having a front end and a rear end, a connecting member coupled to said front end of said rear member and to said rear end of said front member such that said front and rear members may turn relative to each other, handle means coupled to said front member for use for turning said front member relative to said rear member, a paddle shaft, paddles having inner ends coupled to said paddle shaft and outer ends extending outward from said paddle shaft, support means coupled to said rear end of said front member for supporting said paddle shaft and said paddles for rotation about a paddle axis, said support means supports said paddle shaft in a position such that as said paddles rotate, said outer ends of said paddles pass below said paddle shaft and enter and then leave the water as they are rotated, a seat coupled to said rear member for supporting a person, and pedals coupled to said paddle shaft for operation by a person's feet for rotating said paddle shaft and said paddles for moving said front member and hence said rear member in the water.

2. The water apparatus of claim 1, comprising:

a main shaft coupled to said rear end of said front member and extending upward relative to said front member, said connecting member being coupled said main shaft such that said front and rear members may turn relative to each other.

3. The water apparatus of claim 1, wherein:

said support means comprises, two spaced apart support members extending rearward from said rear end of said front member and then upward, said paddle shaft extends through said two support members with said paddles being connected to said paddle shaft for rotation between said two support members.

4. The water cycle apparatus of claim 2, wherein:

said support means comprises, two spaced apart support members extending rearward from said rear end of said front member and then upward, said paddle shaft extends through said two support members with said paddles being connected to said paddle shaft for rotation between said two support members.

5. A water skiff, comprising:

front and rear floatable members constructed to float in water, each of said members having a front end and a rear end, means for couping said front end of said rear member to said rear end of said front member, two rods pivotally coupled to opposite sides of said rear end of said front member respectively, each of said rods having an upper end and a lower end, paddles coupled to said lower ends of said two rods respectively, each of said paddles comprises two plate members each of which has an inner end and an outer end with said two plate members having their inner ends pivotally coupled to said lower end of its said rod for movement to closed positions where said outer ends are close to each other and to extended positions where said outer ends are spaced away from each other, when said lower ends of said two rods are moved rearward, said outer ends of their said plate members move to said extended positions for moving said front and rear floatable members forward in the water and when said lower ends of said rods are moved forward, said outer ends of their said plate members move to said closed positions for minimizing movement of said front and rear members in the water.

6. The water skiff of claim 5, comprising:

means for limiting movement of said plate members of said paddles to their said expanded positions.

7. The water skiff of claim 5, comprising:

said upper ends of said two rods are coupled together to cause movement of said two rods together.

8. The water skiff of claim 6, wherein:

said upper ends of said two rods are coupled together to cause movement of said two rods together.

9. The apparatus of claim 5, wherein:

said means for coupling said front end of said rear member to said rear end of said front member allows said front and rear members to turn relative to each other.

10. The apparatus of claim 9, comprising:

a seat coupled to said rear member for supporting a person.

11. A water apparatus, comprising:

front and rear floatable members constructed to float in water, each of said members having a front end and a rear end, means for coupling said front end of said rear member to said rear end of said front member such that said front and rear members may turn relative to each other, handle means coupled to said front member for use for turning said front member relative to said rear member, a paddle shaft means having first and second spaced apart ends, first and second spaced apart paddle means coupled to said first and second ends respectively of said paddle shaft means, support means coupled to said rear end of said front member for supporting said paddle shaft means and said paddle means for rotation, a seat coupled to said rear member for supporting a person, and pedals coupled to said paddle shaft means for operation by a person's feet for rotating said paddle shaft means and said paddle means for moving said front member and hence said rear member in the water.

12. The apparatus of claim 9, wherein:

said paddle means comprises:

spaced apart first and second paddle support means coupled to said first and second ends of said paddle shaft means respectively, said first and second paddle support means have inner sides which face each other and outer sides which face away from each other, paddles coupled to outer sides of said first and second paddle support means.

13. The apparatus of claim 10, wherein:

each of said paddle support means has a central axis with paddles coupled to said outer side of said paddle support means around said central axis, said paddle shaft means comprises a main shaft portion having opposite ends and an L-shaped end portion coupled to each end of said main shaft portion, said L-shaped portions comprise two inner connecting portions connected to said opposite ends of said main shaft portion transversely to said main shaft portion such that said two inner connecting portions extend in opposite directions from said main shaft portion in the same plane and are generally parallel to each other, said L-shaped portions comprise two outer connecting portions which extend outward in said plane and are generally parallel to each other and to said main shaft portion, said two outer connecting portions being connected to said first and second paddle support means respectively offset from their said central axes.

14. The water apparatus of claim 12, wherein:

each of said paddle support means has an axis with a plurality of said paddles being coupled to each of said paddle support means around it said axis and extending radially relative to it said axis.

15. The water apparatus of claim 14, wherein:

each of said paddle support means has an outer periphery with said paddles being located substantially entirely inward of said outer periphery.

16. The water apparatus of claim 12, wherein:

said first and second paddle support means are generally planar in shape and generally parallel to each other.

17. The apparatus of claim 14, wherein:

said first and second paddle support means are generally planar in shape and generally parallel to each other.

18. The apparatus of claim 15, wherein:

said first and second paddle support means are generally planar in shape and generally parallel to each other.

19. The apparatus of claim 14, wherein:

said first and second ends of said paddle shaft means are coupled to said first and second paddle support means offset from their said axes respectively.

20. The apparatus of claim 15, wherein:

said first and second ends of said paddle shaft means are coupled to said first and second paddle support means offset from their said axes respectively.

21. The apparatus of claim 16, wherein:

said first and second ends of said paddle shaft means are coupled to said first and second paddle support means offset from their said axes respectively.

* * * * *